US006192928B1

(12) United States Patent
Knoell et al.

(10) Patent No.: US 6,192,928 B1
(45) Date of Patent: Feb. 27, 2001

(54) VALVE ASSEMBLY

(75) Inventors: Burkhard Knoell, Lohr; Winfried Rueb, Neustadt, both of (DE)

(73) Assignee: Mannesmann Rexroth AG, Lohr (DE)

( * ) Notice: Subject to any disclaimer, the term of this patent is extended or adjusted under 35 U.S.C. 154(b) by 0 days.

(21) Appl. No.: 09/297,831

(22) PCT Filed: Oct. 20, 1997

(86) PCT No.: PCT/DE97/02425

§ 371 Date: May 19, 1999

§ 102(e) Date: May 19, 1999

(87) PCT Pub. No.: WO98/21485

PCT Pub. Date: May 22, 1998

(30) Foreign Application Priority Data

Nov. 11, 1996 (DE) ..... 196 46 445

(51) Int. Cl.[7] ..... F15B 11/05; F15B 13/044

(52) U.S. Cl. ..... 137/596; 91/446; 91/518; 137/625.68

(58) Field of Search ..... 91/446, 447, 518; 137/596, 625.68

(56) References Cited

U.S. PATENT DOCUMENTS

| | | | | |
|---|---|---|---|---|
| 2,888,943 | | 6/1959 | Hipple . | |
| 3,744,518 | | 7/1973 | Stacey . | |
| 3,910,311 | * | 10/1975 | Wilke | 137/596 |
| 3,985,153 | * | 10/1976 | Thomas | 91/446 X |
| 4,117,862 | * | 10/1978 | Qureshi | 91/446 X |
| 4,187,877 | * | 2/1980 | Hodgson et al. | 137/625.68 X |
| 4,290,447 | * | 9/1981 | Knutson | 137/596.2 |
| 4,388,946 | * | 6/1983 | Richter et al. | 91/446 X |
| 4,520,841 | * | 6/1985 | Brand et al. | 137/625.68 |
| 4,617,798 | * | 10/1986 | Krusche et al. | 137/625.68 X |
| 4,631,923 | | 12/1986 | Smith . | |
| 4,705,069 | * | 11/1987 | Fertig | 91/446 X |
| 4,719,753 | | 1/1988 | Kropp . | |
| 4,723,475 | | 2/1988 | Burk . | |
| 4,738,279 | * | 4/1988 | Kropp | 91/446 X |

FOREIGN PATENT DOCUMENTS

| | | | | |
|---|---|---|---|---|
| 2647140 | * | 4/1978 | (DE) | 137/596 |
| 2649775 | * | 5/1978 | (DE) | 137/596 |
| 28 31 697 | | 1/1980 | (DE) . | |
| 31 15 114 | | 4/1982 | (DE) . | |
| 3346463 | * | 7/1984 | (DE) | 137/625.68 |
| 3605312 A1 | | 8/1986 | (DE) . | |
| 3634728 C2 | | 4/1988 | (DE) . | |
| 39 18 926 | | 2/1991 | (DE) . | |
| 42 34 037 | | 4/1994 | (DE) . | |
| 44 46 142 | | 6/1996 | (DE) . | |
| 196 46 425 A1 | | 5/1998 | (DE) . | |
| 2 195 745 | | 4/1988 | (GB) . | |

* cited by examiner

*Primary Examiner*—Gerald A. Michalsky
(74) *Attorney, Agent, or Firm*—Oliff & Berridge, PLC

(57) ABSTRACT

A valve assembly for pressure adapted and volumetric flow adapted supply of at least one user may be supplied with hydraulic fluid or connected to a tank via two work ports of a continuously adjustable directional control valve. To the two work ports of the valve assembly a common pressure compensator is associated, the piston of which is guided in axial translation in an axial bore of the directional control valve spool, so that one of the two work ports may optionally be connected to the pump port upon suitable actuation of the directional control valve. At both end surfaces of the directional control valve spool and at the spring side of the pressure compensator piston, there acts a respective control pressure which, for example, corresponds to the highest system load pressure, the individual load pressure, or a pressure derived therefrom.

14 Claims, 4 Drawing Sheets

VALVE ASSEMBLY

BACKGROUND OF THE INVENTION

The invention relates to a valve assembly for pressure adapted and volumetric flow adapted supply of at least one user in.

The like valve assemblies are employed, for example, in mobile hydraulics for controlling users, in particular single and double-action cylinders. Double-action cylinders are frequently employed in front power lifts of farming tractors. The previous rear power lifts were in most cases constructed with single-action cylinders, however owing to the variegated applications of modern tractors there is an increasing trend to also equip the rear power lifts with double-action cylinders. With the aid of such power lifts, various peripheral tools such as, for example, balers, ploughs, cultivators, rollers, etc. may be coupled to a tractor and actuated.

In mobile hydraulics it is an objective to make the design of the valve assemblies as compact as possible, for which reason they are frequently designed in subplate mounting or as a compact block or monoblock. To this end, the required ports such as, for example, pump port, control port, work port, tank port, and the housing bores necessary for receiving the valve actuating members are formed in the basic body of the valve plate or of the compact block.

In manually operated valve assemblies, the mechanical spool is designed to project from the valve housing (plate, block), and this external chamber of the valve axis is connected to the tank. In order to satisfy the modular principle, this construction intended for mechanically actuated valve assemblies is also applied to electrically actuated valves, so that considerable expense in terms of device technology must be incurred for realising the external pressure chambers and the corresponding connection conduits toward the tank.

In mobile hydraulics, load sensing systems are being employed whereby a through flow independent of load pressure, and thus sensitive velocity control of the user, is attained. Herein the pressure difference across the directional control valve is maintained constant by providing in the user ports individual pressure compensators which throttle the system pressure, i.e., the pressure of the highest load in the system, to the respective user pressure.

In the like load sensing systems, the individual pressure compensators and their control conduits must, accordingly, also be accommodated in the valve housing (plate, block) of the valve assembly.

DE 36 34 728 C2 discloses a valve assembly for load independent control of several double-action hydraulic users, wherein the metering orifice is realised in the form of fine control grooves of the directional control valve, and downstream from this metering orifice an individual pressure compensator is received in a valve housing bore through which the hydraulic fluid may be supplied to a first or second work port depending on actuation of the directional control valve spool. The individual pressure compensator comprises a piston acted upon in the opening direction by the pressure downstream from the metering orifice, and in the closing direction by a spring and a control pressure.

It is a drawback of this embodiment that a receiving bore for the piston of the individual pressure compensator and corresponding conduit systems for supplying the control pressure to the piston rear side must be formed in the housing of the valve assembly, so that considerable expense in terms of production technology is required for manufacturing the valve housing. It is another drawback that, upon use of a different individual pressure compensator, it may eventually become necessary to modify the valve housing bore, so that it is necessary to provide various valve housing construction types.

DE-OS 36 05 312 discloses a valve assembly wherein the directional control valve spool is designed as a hollow spool wherein pocket hole bores for receiving a respective piston of an individual pressure compensator from both end portions are provided. The metering orifice of the directional control valves is constituted by a jacket bore of the directional control valve spool and an annular chamber of the valve housing connected to the pump port. Through this jacket bore the hydraulic fluid may enter into one of the pocket hole bores in accordance with actuation of the directional control valve spool, so that the corresponding piston of the individual pressure compensator is displaced against a spring bias, and the corresponding work port is controlled open in order to supply the user, in this case a double-action hydraulic cylinder, with hydraulic fluid.

In this variant, a separate valve housing bore for receiving the individual pressure compensators need not be realised in contrast with the above described construction. The variant known from DE-OS 3 605 312 does, however, have the drawback that to each work port a separate individual pressure compensator is associated, resulting in a very complicated construction of the hollow piston. In addition, in such a construction it is necessary to select the tolerances in manufacture of the two individual pressure compensators very narrowly in order to attain identical response characteristics in both work ports. Any variations in the response characteristics might engender instabilities in actuation of the user, which certainly are not acceptable in view of the quality criteria to be applied nowadays.

An object of the present invention is furnishing a valve assembly for pressure adapted and volumetric flow adapted supply, whereby secure control of a user is ensured at minimum expense in terms of device technology.

This object is attained by a valve assembly having a continuously adjustable directional control valve associated with a pressure compensator having a piston, which is guided in a hollow spool of the directional control valve. The piston is acted upon in the opening direction by pressure downstream from a metering orifice constituted by the directional control valve, and is acted upon in the closing direction by a control spring and a control pressure. Through axial displacement of the piston, a jacket bore of said spool may be controlled open in such a way that a connection with one of two work ports may be selectively established depending on the spool position.

By the measure of guiding the piston of the individual pressure compensator in a hollow spool provided with a jacket bore, which may be controlled open by axial displacement of the pressure compensator piston on the one hand and, depending on the position of the directional control valve spool (hollow spool), establishes a connection with a first or second work port on the other hand, expense in terms of device technology may be reduced quite considerably in comparison with the above described solutions because neither a separate receiving bore for the individual pressure compensator in the valve housing nor corresponding means for receiving a second pressure compensator piston in the directional control valve spool must be provided.

The invention thus makes it possible to provide the valve housing with an extremely compact design, with all of the essential control and connection conduits being realised in the directional control valve spool or in the piston of the individual pressure compensator, while pump port, tank port, control port, etc. are provided in the valve housing. The latter may thus be used in a multiplicity of various valve assemblies essentially without modifications, whereas it is possible to carry out the individual adaptations with comparative ease by variation of the directional control valve spool and of the pressure compensator piston.

It is particularly advantageous if the end surfaces of the directional control valve spool are acted on by the control pressure which may, for example, be the individual load pressure of the user, a pressure derived therefrom, for example an artificially increased pressure, or the highest system load pressure, whereby it is ensured that an identical control pressure prevails on both control sides of the directional control valve.

A separate control conduit for actuating the individual pressure compensator piston may be omitted in that the control pressure present at the control sides of the directional control valve spool is guided through a control passage to the spring side of the pressure compensator piston.

For the case that the individual load pressure at the respective user is higher than the control pressure present, it is possible to design the pressure compensator piston to include a connecting bore through which the pressure compensator piston spring chamber may be connected to the piston front side upon a predetermined axial displacement of the pressure compensator piston, so that the individual load pressure is also present at the back side (spring chamber) of the pressure compensator piston. As a result of the above described control passage in the main spool, this individual load pressure is also passed on to the control sides of the directional control valve spool, where it is ensured that the control pressure corresponds to a respective highest system load pressure. In this case, the pressure compensator piston also fulfils the function of a shuttle valve as used in conventional solutions for passing on the highest load pressure in the system.

Axial displacement in the closing direction may most conveniently be limited by providing the pressure compensator piston with a radial collar which may be taken into contact with a correspondingly shaped shoulder of the spool bore. This shoulder may at the same time be employed for controlling open the connecting bore, so that the shoulder acquires a double function.

A valve assembly having particularly variegated applicability includes two directional control valve spools, each of which is designed as a hollow spool with an individual pressure compensator piston guided therein, so that in the valve housing merely the work ports, the tank port, the work port, the corresponding passages and the connecting passages for application of the control pressure to the front sides of the hollow spool must be realised.

The supply conduit to the user may be cut off leak-free through provision of an electrically releasable non-return cartridge valve, with only the screw-in portion for the non-return cartridge valve having to be provided in the valve housing.

DETAILED DESCRIPTION OF PREFERRED EMBODIMENTS

Figure 1:
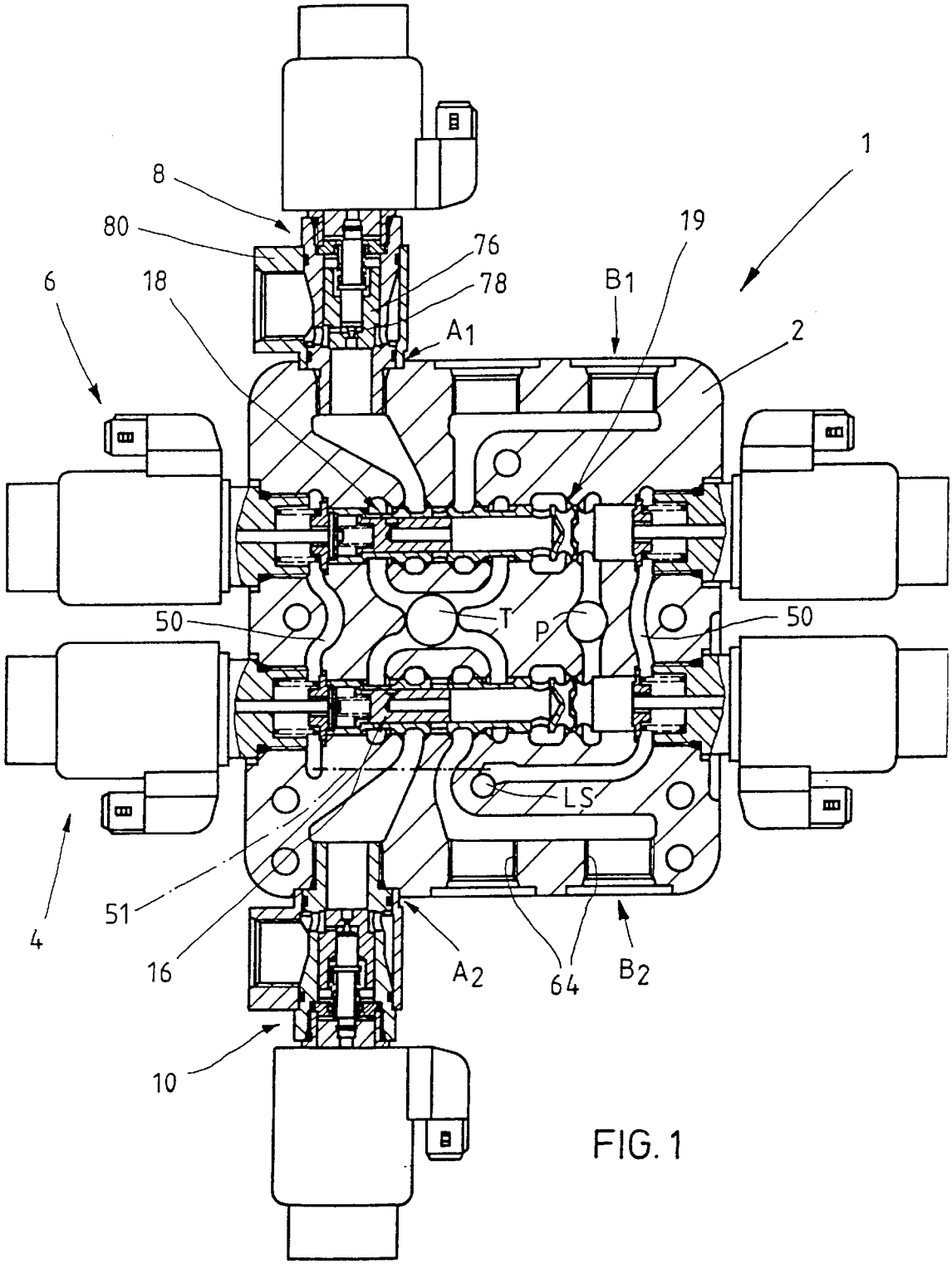
FIG. 1 is a sectional view of a valve assembly in accordance with the invention which includes two directional control valves.

FIG. 1 shows a basic embodiment of a valve assembly 1 according to the invention in subplate mounting, wherein in a valve plate 2 a pump port P, a tank port T, and a control port LS are realised. In the valve plate there are moreover accommodated two electrically actuated, continuously adjustable directional control valves 4, 6 through which the pump port P and the tank port T may selectively be connected to work ports A1, B1, A2, or B2. These work ports are, for example, connected via work conduits (not represented) with the two cylinder chambers of a double-action hydraulic cylinder of lifting gear.

To each directional control valve 4, 6 there is associated an individual pressure compensator 16 or 18 and a metering orifice 19 whereby the system pressure, i.e., the pressure present at the pump port P, is throttled to the respective individual user pressure (load pressure).

A respective electrically actuated non-return valve 8, 10 having a cartridge design is screwed into the work ports A1, A2.

The identical construction of the two directional control valves 4, 6 shall now be described by referring to FIG. 2 which shows an enlarged view of the directional control valve 6.

The directional control valve 6 includes a spool 12 guided in axial translation in a valve bore 14 of the valve plate 2.

The axial displacement of the spool 12 is performed through the intermediary of impulse electromagnets 15, 17 arranged on either side, the tappets 21, 23 of which act on the two end or control sides 20, 22 of the spool 12. At this end surface 20, 22 a respective spring retainer 24, 26 is supported, on which in turn a respective pressure spring 28, 30 acts, both of which are supported at the internal bore of a screw-in portion of the electromagnets 15 and 17, respectively.

In the starting position of the spool 12 set by the spring bias the spring retainers 24, 26 contact a shoulder of the valve bore 14 with a radial flange.

Figure 2:
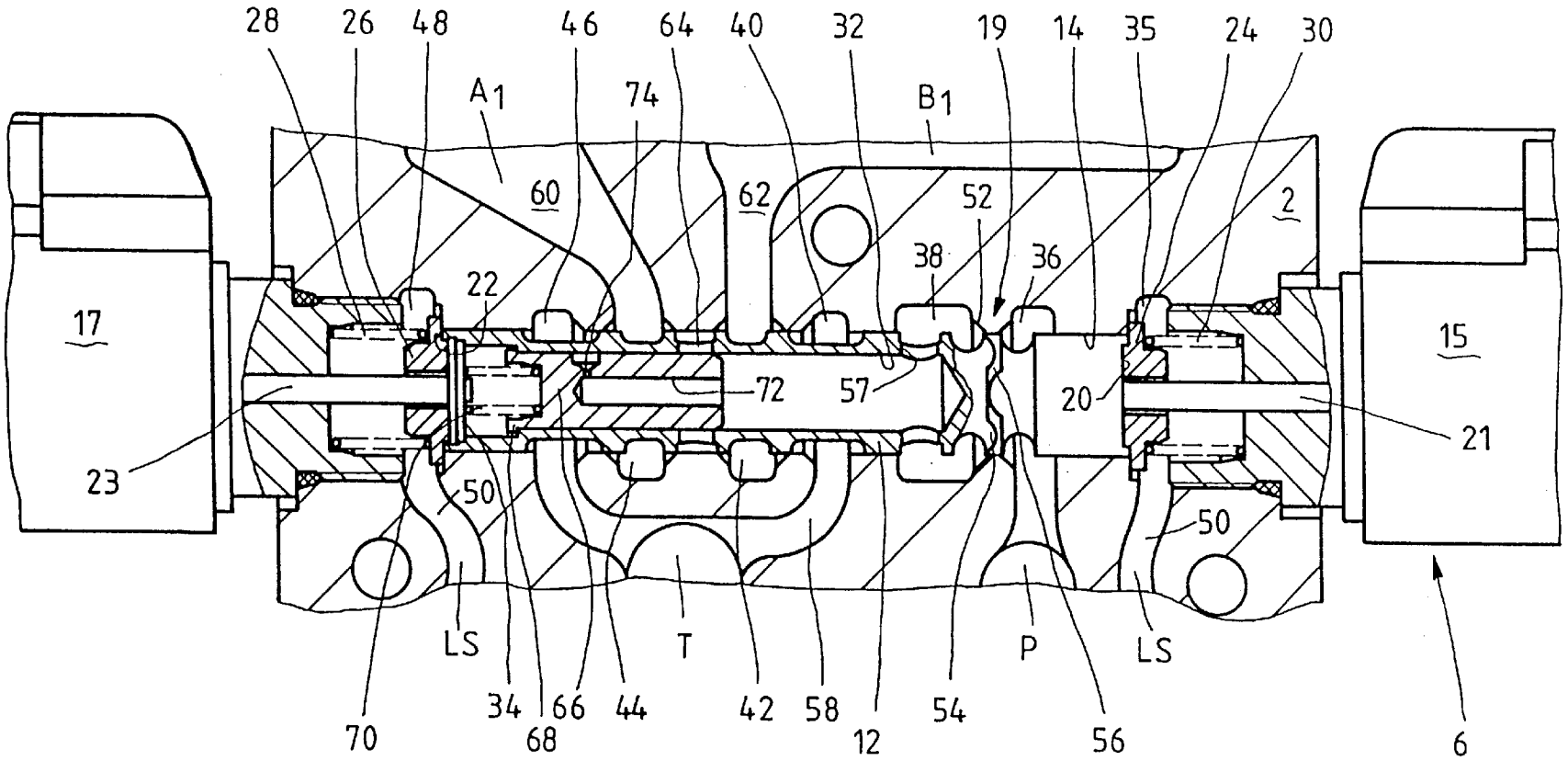
FIG. 2 is an enlarged representation of a directional control valve of the valve assembly according to FIG. 1.

The spool 12 is provided with an axial bore 32 designed as a pocket hole which opens into the left-hand end surface 22 of the spool 12 in the representation of FIG. 2. As this end surface (22) is designed as an annular end surface, the associated tappet 23 acts on a stop disk 34 which contacts a shoulder of the axial bore 32, and, for example, is held in the axial bore 32 in the axial direction by means of a lock washer (not shown).

The valve bore is provided with annular chambers 35, 36, 38, 40, 42, 44, 46 and 48, with the annular chambers 35 and 48 being connected to port LS via a load indicator channel 50. As can be seen from FIG. 1, all of the end surfaces 20, 22 of the spool 12 are interconnected via the load indicator channels 50 and a dash-dotted connecting passage 51 and the associated annular chambers 35 and 48 (FIG. 2), so that a unified control pressure acts on them.

The annular web remaining between the two annular chambers 36, 38 has the form of an orifice bore 52 forming the metering orifice 19 jointly with a spool portion 54. The spool portion 54 is provided with fine control grooves 56, so that the metering orifice cross-section may be adjusted continuously by correspondingly energising the electromagnets 15, 17. The volumetric flow of hydraulic fluid supplied to the user is thus adjusted by means of the metering orifice 52, 54 so that, for example, the velocity of an outward movement of lifting gear can be adjusted.

In the range of the annular chamber 38 the jacket of the spool 12 is provided with an inlet bore 57 (bore star) opening into the axial bore 32. The two annular chambers 40 and 46 are connected to the tank port T via a tank passage 58. The two annular chambers 42, 44 located between the annular chambers 46 and 40 are connected to the work ports A1 and B1 via connecting passages 60 and 62. As can be seen from FIG. 1, the ports B1 and B2 are designed as a double port with two parallel connecting bores 64. Between the annular chambers 42 and 44 associated with the two work ports A1 and B1 a jacket bore or, more precisely, a jacket bore star 64 is formed in the spool 12, which also communicates with the axial bore 32.

To each of the annular chambers 36 to 48 a corresponding annular groove at the outer circumference of the spool 12 is associated, which grooves did not receive a reference symbol in FIG. 2 for the sake of simplicity. Via these annular grooves a connection between the adjacent channels, i.e., between work port and tank port or pump port, may be established by displacement of the spool 12. In the corner regions of the annular chambers 36*ff* notches or adaptations are formed, whereby optimum opening control of the respective connections is made possible.

In the axial bore 32 a pressure compensator piston 66 is received which closes the jacket bore star 64 in its represented basic position. The pressure compensator piston, hereinafter referred to as piston 66, includes at its left-hand end portion in accordance with FIG. 2 a radial collar 68 acted upon by a control spring 70 which is supported on the stop disk 34. In the shown starting position, the piston 66 is biased with its radial collar 68 against a shoulder of the axial bore 32 by means of the control spring 70.

The piston 66 moreover includes a connecting bore consisting of a longitudinal bore 72 and a radial throttle bore 74 intersecting it. The longitudinal bore 72 has the form of a pocket hole bore and opens into the right-hand end surface of the piston 66 in the representation of FIG. 2. The radial throttle bore 74 has a smaller cross-section than the longitudinal bore and serves as an attenuation throttle.

The stop disk 34 and the spring retainer 26 are provided with a control passage (not shown) through which the pressure in the spring chamber of the pressure spring 28 is also transferred to the spring chamber for the control spring 70, so that the piston 66 is pushed into its stop position (FIG. 2) by the action of the control spring 70 and by the control pressure acting at the control port LS.

If, now, for example, port A1 is to be supplied with hydraulic fluid, and port B1 is to be connected with the tank T, the electromagnet 15 is energised, so that the tappet 21, in dependence on the applied current, performs a stroke to the left.

This stroke is transmitted directly to the control spool 12, so that the orifice bore 52 is controlled open by the spool portion 54 moving to the left in the representation of FIG. 2. The hydraulic fluid may then flow from the pump port P into the annular chamber 38 and from there through the inlet bore 57 into the inner cavity of the axial bore 32.

The adjacent end surface of the piston 66 is then supplied with the pressure prevailing downstream from the orifice bore 52 and shifted to the left against the force of the control spring 70 and the prevailing control pressure until equilibrium is established.

By this axial displacement of the piston 66 the jacket bore star 64 is controlled open, so that the hydraulic fluid flows through the control orifice of the pressure compensator 18 constituted by the piston 66 and the radial bore star 64 (FIG. 1) into the connecting passage 60 and from there on to the port A1.

The fluid returning from the user enters from the work port B1 via the connecting passage 62 and the associated annular groove of the spool 12 into the annular chamber 40 and from there into the tank passage 58 and on to the tank port T.

When the electromagnets 17 are energised, the work port B1 is correspondingly connected with the pump port P and the work port A1 to the tank port T.

By the pressure compensator (control orifice with the radial bore star 64 and the piston 66) the prevailing system pressure, i.e., the pressure in the axial bore 32, is throttled to the load pressure of the connected user, so that the pressure drop across the metering orifice (orifice bore 52, spool portion 54) remains constant and thus a volumetric flow independent of the load pressure is ensured. As the control spring 70 has a very low spring rate, the pressure upstream from the piston 66 in a first approximation about corresponds to the load pressure at the work port A1 (B1).

For the case that the system pressure (load pressure) is greater than the control pressure prevailing in the spring chamber for the control spring 70, the piston 66 is moved to the left until the radial throttle bore 74 is controlled open by the axial bore shoulder acting as a stop for the radial collar 68, so that the higher pressure upstream from the piston 66 is also transferred to the spring side of the piston 66 and thus also into the spring chamber of the pressure spring 28. In this way the piston 66 acts, as it were, as a shuttle valve whereby it is ensured that the respective highest load pressure will be present in the load indicator channels 50, 51 and thus at the control port LS.

As can be seen from FIG. 1, a non-return valve 8 is provided in the work port A1.

The non-return valve 8 represented in FIG. 1 is a non-return valve with a pilot opening, wherein the pilot opening tappet 78 is directly connected to the armature of an electromagnet. By energising this electromagnet it is possible to release the non-return valve 8, so that the main poppet 76 upon flow through it from the user toward the work port A1 rises from its valve seat and thus enables a return flow to the tank T. The non-return valve 8 is provided with a radial port 80 which may be pivoted around the longitudinal axis of the valve, whereby extremely flexible adaptation to the connection conditions of the valve assembly 1 is made possible. The non-return valve 10 (port A1) is of the same construction.

Figure 3:
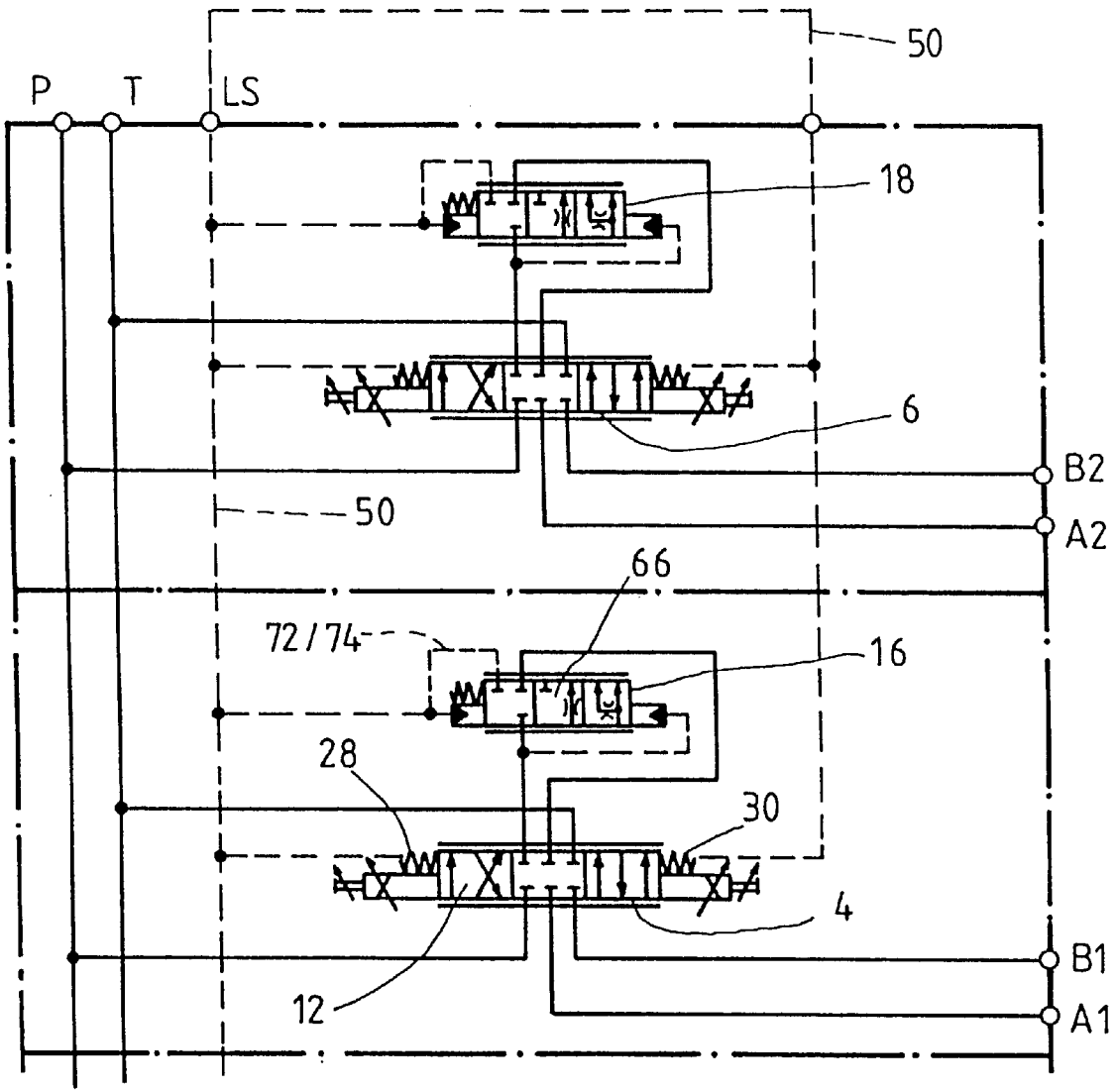
FIG. 3 shows a schematic circuit diagram of part of the valve assembly of FIG. 1.

In FIG. 3 a circuit diagram of the essential members of the valve assembly of FIG. 1 is represented schematically.

Accordingly, two valve groups, each comprised of the continuously adjustable directional control valves 4, 6 and the pressure compensators 16, 18 associated to them are constituted in the valve plate 2. The directional control valve spools are each biased into their basic positions by the two pressure springs 28, 30 and the control pressure (load indicating pressure) in the load indicator channel 50. When energising the electromagnet 30, for example, the corresponding directional control valve spool is shifted to the left in the representation of FIG. 3, so that the pressure present at the pump port P is guided to the pressure compensator 16. The input pressure of the pressure compensator 16 (pressure downstream from the metering orifice of the directional control valve 4) is supplied to the right-hand control side of the pressure compensator 16 in the representation of FIG. 3, while the load indicating pressure is present at the left control side. Hereby the piston 66 is shifted to the left (FIG. 2), so that the control orifice (jacket bore star 64, piston 66) is controlled open and the hydraulic fluid is conveyed via the directional control valve 4 to the work port A1.

In this position of the spool 12, the hydraulic fluid is conveyed from the user via port B1 and the directional control valve 4 to the tank port T while bypassing the pressure compensator. Upon further increase of the pressure at the entrance of the pressure compensator 16, the piston 66 is pushed further to the left until the connecting bore (72, 74) is controlled open and the input pressure of the pressure compensator is supplied into the load indicator channel 50, so that this pressure subsequently acts as a control pressure. In FIG. 3 the non-return valves 8, 10 were omitted for the sake of simplicity.

Figure 4:
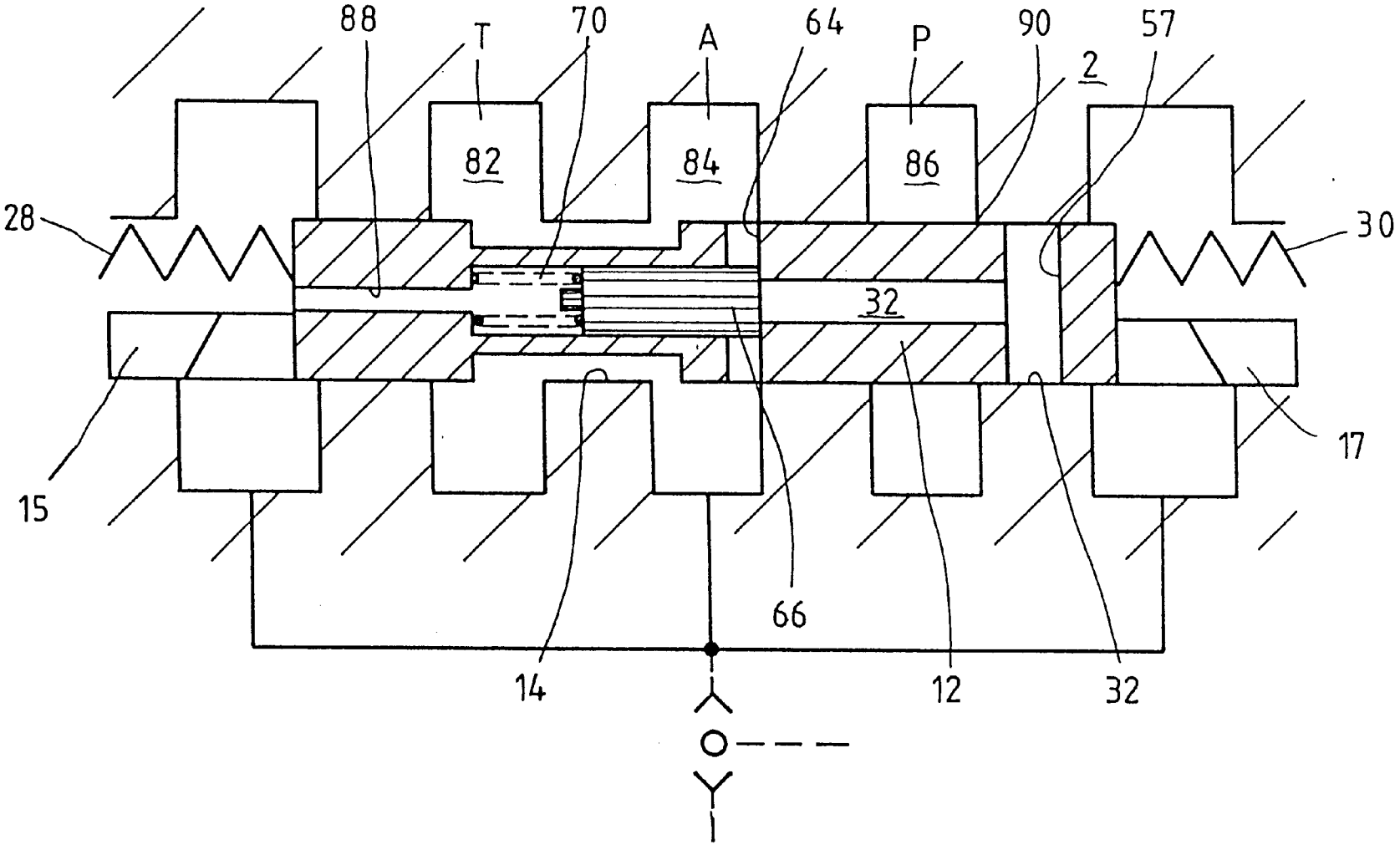
FIG. 4 is a simplified variant of a single-action directional control valve.

FIG. 4, finally, shows a simplified embodiment of a valve assembly which is a single-action directional control valve for closed center load sensing systems. Inasmuch as the essential components of such a unidirectional valve are identical with the components of the above described valve assembly, the construction of the simplified valve is only indicated schematically in FIG. 4. This valve assembly includes a pump port P, a single work port A, and a tank port T, which open into annular chambers 82, 84 and 86 of the valve bore 14. The directional control valve, in turn, is designed as an electrically actuated proportional valve, wherein the spool 12 is actuated through electromagnets 15, 17 arranged on either side. On both end surfaces of the spool 12 two pressure springs 28, 30 are formed, and the spring chambers of these pressure springs 28, 30 are connected to the work port A or (not represented) to the load indicator channel 50 through connection conduits.

The spool 12, in turn, is designed as a hollow spool, in the axial bore 32 of which a pressure compensator piston 66 is guided, whereby a jacket bore star 64 may be controlled open. The piston 66 is biased into its represented closing position by a control spring 70. The pressure compensator piston 66 may fundamentally have the same construction as the one of FIG. 2, so that more detailed descriptions may be omitted. The spring chamber for the control spring 70 is connected to the spring chamber for the pressure spring 28 via a control passage 88, so that in both spring chambers an identical pressure prevails.

When the electromagnets 17 are energised, the inlet bore 57 is controlled open by the control land 90 of the annular chambers 86, so that the pump port is connected to the axial bore 32 and the piston 66 is displaced against the bias of the control spring 70 and the control pressure in the spring chamber in the axial leftward direction (FIG. 4). As a result, the control orifice opens, so that the pump port P is connected via the metering orifice of the directional control valve (inlet bore 57, control land 90) and the control orifice (piston 66, radial bore star 64) to the work port A and a single-action user, for example, a single-action lifting cylinder, is actuated.

When the electromagnets 15 are energised, the connection between P and A is controlled closed and the connection between the tank T and the work port A is controlled open, so that the hydraulic fluid may flow back from the user. In this alternative, too, it is possible to choose a very simple construction of the valve plate 2 owing to the connection of the two spring chambers of the directional control valve spool 12 and guidance of the pressure compensator in an axial bore 32 of the directional control valve spool 12, so that it may be employed in various arrangements without any major modifications.

The above described valve assemblies may be used, for example, as lifting gear valves for constant current equipment (fixed displacement pump) with single and double-action lifting gear cylinders or for lifting gear valves for pressure/throughput controlled systems or, more generally, for directional control valves in load sensing systems as employed, for example, in stacker trucks, tractors and farming machinery. The solution according to the invention is characterised by a very simple and compact construction, wherein in particular the structural length is reduced to minimum because a substantial portion of the pressure compensator and of the load pressure indicator conduit may be integrated into the hollow spool.

What is disclosed is a valve assembly for pressure adapted and volumetric flow adapted supply of at least one user, which may be supplied with hydraulic fluid or connected to a tank via two work ports of a continuously adjustable directional control valve. To the two work ports of the valve assembly a common pressure compensator is associated, the piston of which is guided in axial translation in an axial bore of the directional control valve spool, so that one of the two work ports may optionally be connected to the pump port upon suitable actuation of the directional control valve. At both end surfaces of the directional control valve spool and at the spring side of the pressure compensator piston there acts a respective control pressure, which, for example, corresponds to the highest system load pressure, the individual load pressure, or a pressure derived therefrom.

What is claimed is:

1. A valve assembly for pressure adapted and volumetric flow adapted supply of at least one user, comprising:

a tank;

a continuously adjustable directional control valve having two work ports for supplying hydraulic fluid to the at least one user, or for connecting the at least one user to the tank, the directional control valve including:

a pressure compensator, the pressure compensator including a piston that moves in a closing direction and an opening direction;

a metering orifice such that hydraulic pressure downstream from the metering orifice acts upon the piston in the opening direction;

a control spring such that the control spring and a control pressure act upon the piston in the closing direction; and a hollow spool having two end sides and a bore through which said piston is guided;

wherein a first connection between the bore and a work port is established through axial displacement of the piston within the bore of the spool from a neutral position into a first working position, and a second connection between the bore and another work port is established through axial displacement of the piston within the bore of the spool from a neutral position into a second working position.

2. A valve assembly according to claim 1, wherein both end sides of said spool are acted upon by the control pressure.

3. A valve assembly according to claim 2, wherein said piston includes a connecting bore through which a piston end side may be connected to a piston spring chamber upon a predetermined axial displacement of said piston.

4. A valve assembly according to claim 1, wherein said piston includes a connecting bore through which a piston end side may be connected to a piston spring chamber upon a predetermined axial displacement of said piston.

5. A valve assembly according to the claim 4, wherein said metering orifice is constituted by an orifice bore and a piston portion at the outer circumference of said spool, and downstream from said metering orifice an inlet bore is formed which opens into an axial bore of said spool and whereby hydraulic pressure may be applied to the end side of said piston.

6. A valve assembly according to claim 5, wherein said piston is biased with a radial collar against a shoulder of said axial bore, with said shoulder acting as a control land for controlling open said connecting bore.

7. A valve assembly according to claim 4, wherein said piston is biased with a radial collar against a shoulder of an axial bore of said spool, with said shoulder acting as a control land for controlling open said connecting bore.

8. A valve assembly according to claim 1, wherein an end side of the spool adjacent the spring side of said piston is provided with a control passage through which the control pressure present at said spool end side may be guided to the piston spring side.

9. A valve assembly according to claim 1, wherein the control pressure is an individual load pressure of the user.

10. A valve assembly according to claim 1, comprising two electrically actuated directional control valves to which a respective pressure compensator is associated, with a common pump port, a common tank port and a common control pressure port being formed in the valve housing, and at least two work ports being associated to each directional control valve, and the end sides of the spool of each said directional control valve receiving an identical control pressure.

11. A valve assembly according to claim 10, wherein the control pressure is the highest load pressure.

12. A valve assembly according to claim 11, wherein an electrically actuated non-return cartridge valve is screwed into the outlet work port.

13. A valve assembly according to claim 10, wherein an electrically actuated non-return cartridge valve is screwed into the outlet work port.

14. A valve assembly according to claim 1, wherein said metering orifice is constituted by an orifice bore and a piston portion at the outer circumference of said spool, and downstream from said metering orifice an inlet bore is formed which opens into an axial bore of said spool and whereby hydraulic pressure may be applied to the end side of the piston.

* * * * *